US006692560B2

(12) United States Patent
Holmberg et al.

(10) Patent No.: US 6,692,560 B2
(45) Date of Patent: Feb. 17, 2004

(54) SIZING COMPOSITION

(75) Inventors: Krister Holmberg, Göteborg (SE); Håkan Leijon, Hyltebruk (SE); Kristina Mohlin, Göteborg (SE)

(73) Assignee: Akzo Nobel N.V., Arnhem (NL)

( * ) Notice: Subject to any disclaimer, the term of this patent is extended or adjusted under 35 U.S.C. 154(b) by 0 days.

(21) Appl. No.: 10/141,803

(22) Filed: May 8, 2002

(65) Prior Publication Data

US 2003/0097964 A1 May 29, 2003

Related U.S. Application Data

(60) Provisional application No. 60/289,347, filed on May 8, 2001.

(30) Foreign Application Priority Data

May 9, 2001 (EP) ..... 01850086

(51) Int. Cl.[7] ..... D21H 17/72; D21H 17/06; D21H 17/14; D21H 17/17

(52) U.S. Cl. ..... 106/287.2; 106/287.26; 162/158

(58) Field of Search ..... 106/287.2, 287.26; 162/158

(56) References Cited

U.S. PATENT DOCUMENTS

| | | | | |
|---|---|---|---|---|
| 3,887,427 A | | 6/1975 | Helmer et al. | 162/158 |
| 4,376,177 A | | 3/1983 | Matsunaga et al. | 524/35 |
| 4,522,686 A | | 6/1985 | Dumas | 162/158 |
| 5,059,675 A | | 10/1991 | Carlin et al. | 528/254 |
| 6,444,024 B1 | * | 9/2002 | Mills et al. | 106/287.23 |

FOREIGN PATENT DOCUMENTS

| | | | | |
|---|---|---|---|---|
| EP | 0984101 A1 | | 3/2000 | D21H/17/18 |
| GB | 2122659 A | * | 1/1984 | |
| GB | 2122659 A | | 1/1984 | D06M/13/20 |
| JP | 60-17198 | | 1/1985 | D21H/3/60 |
| WO | 97/49865 | | 12/1997 | D21H/21/16 |
| WO | WO 01/59214 A1 | | 8/2001 | D21H/17/16 |

OTHER PUBLICATIONS

Derwent Abstract No. 1985–059895 abstracting JP 60–17198, Jul. 1983.

International Search Report of International Application No. PCT/SE 02/00859, dated Sep. 4, 2002.

Derwent Abstract XP–002174655 (1985), no month provided, abstracting JP60099099A.

Derwent Abstract XP–002174656 (1985), no month provided, abstracting JP60028583.

* cited by examiner

*Primary Examiner*—David Brunsman
(74) *Attorney, Agent, or Firm*—Lainie E. Parker; Michelle J. Burke

(57) ABSTRACT

The present invention refers to an essentially water-free sizing composition and an aqueous sizing dispersion comprising a sizing agent, a non-ionic surfactant, an anionic surfactant and a monohydric alcohol. The invention also relates to a method for producing an aqueous dispersion comprising the above components and the use of the dispersion for surface and stock sizing.

27 Claims, No Drawings

SIZING COMPOSITION

This application claims priority of U.S. Provisional Patent Application No. 60/289,347, filed May 8, 2001, and European Patent Application No. 01850086.8, filed May 9, 2001.

The present invention refers to an essentially water-free composition and an aqueous sizing composition comprising a sizing agent, a non-ionic surfactant, an anionic surfactant and a monohydric alcohol. The invention furthermore encompasses the use of such compositions for stock sizing or surface sizing paper or boar and a method of producing an aqueous dispersion.

BACKGROUND

Sizing agents are used in paper and board production in order to obtain products which have enhanced resistance against penetration of aqueous solutions. The sizing agents are not added as such to the pulp suspension but are added in form of emulsions or dispersions. As the sizing agents commonly are hydrophobic, compounds facilitating the formation of a dispersion are present during homogenisation. The homogenisation is effected by mixing the sizing agent, the dispersing agent or agents in the presence of high shear forces which are introduced by using a high-pressure homogenisation equipment.

There exists a huge number of different sizing agents which may be divided into two groups, namely non-cellulose reactive sizing agent and cellulose-reactive sizing agent where the latter are believed to form covalent bonds to the cellulosic fibres. Cellulose-reactive sizing agents do, however, not only react with the cellulosic fibres of the suspension but also interact with aqueous solutions, i.e. the water content of the dispersion, thereby undergoing hydrolysis which eventually effects a decrease of the amount of active cellulose-reactive sizing agent. Accordingly, the stability of aqueous dispersions or emulsions comprising cellulose-reactive sizing agent is thereby limited.

GB 2122656 discloses a sizing composition comprising a carboxylic acid anhydride and a polyoxyalkylene non-ionic surfactant blocked with a lower alkyl, acyl or carbamoyl group and/or an alkaline earth metal of a sulphur containing anionic surfactant.

U.S. Pat. No. 4,376,177 relates to sizing of woven fabric using sizing compounds.

EP 984101 refers to sizing compositions containing a sizing agent and an organic complexing agent.

WO 9749865 discloses ASA sizing emulsions containing a cationic polymer mixture of low molecular weight water-soluble cationic ionene and high molecular weight cationic polyethylene, furthermore, a surfactant is also present in the emulsion.

U.S. Pat. No. 5,059,675 relates to surface sizing compositions containing the reaction product of melamine formaldehyde compounds with long chain saturated or unsaturated alcohol and polyethoxylated alcohol.

One objective of the present invention is, thus, to provide a sizing composition which is easily homogenisable, i.e. a dispersion or emulsion is formed by only introducing minor shear forces such as gentle stirring.

Another objective of the present invention is to provide storage stable sizing compositions.

Further objectives are mentioned hereinafter.

INVENTION

In accordance with the present invention an essentially water-free sizing composition and an aqueous sizing composition has been found comprising a sizing agent, a non-ionic surfactant, an anionic surfactant and a monohydric alcohol. In addition, the present invention also refers to the use of the composition for stock sizing or surface sizing of paper or board and a method for producing an aqueous dispersion comprising homogenising the sizing agent in the presence of a non-ionic surfactant, an anionic surfactant and a monohydric alcohol.

The sizing agent present in the sizing composition may be non-cellulose-reactive agents including rosin, i.e. disproportionated rosin, hydrogenated rosin, polymerised rosin, formaldehyde-treated rosin, esterified rosin, fortified rosin and mixtures of such treatments and so treated rosins, fatty acids and derivatives thereof, e.g. fatty acid esters and amides like bis-stearamide, resin and derivatives thereof, e.g. hydrocarbon resins, resin acids, resin acid esters and amides, waxes, e.g. crude and refined paraffin waxes, synthetic waxes, naturally occuring waxes, etc, and/or cellulose-reactive agents. Preferably, the sizing agent is a cellulose-reactive sizing agent. The cellulose-reactive-sizing, agents comprised in the sizing dispersion can be selected from any cellulose-reactive agents known in the art. Suitably, the sizing agent is selected from the group consisting of hydrophobic ketene dimers, ketene multimers, acid anhydrides, organic isocyanates, carbamoyl chlorides and mixtures thereof, preferably ketene dimers and acid anhydrides, most preferably ketene dimers. Preferred ketene dimers have the general formula (I) below, wherein $R^1$ and $R^2$ represent saturated or unsaturated non-branched or branched hydrocarbon groups, the hydrocarbon groups suitably having from 8 to 36 carbon atoms, usually being alkyl groups having 12 to 20 carbon atoms, such as hexadecyl and octadecyl groups. In a preferred embodiment the ketene dimers are liquid at ambient temperature, i.e. at 25° C., suitably at 20° C., whereby $R^1$ and/or $R^2$ suitably are unsaturated alkyl groups having 12 to 20 carbon atoms, e.g. oleic group, or shorter alkyl groups with from 8 up to 18 carbon atoms. Suitable acid anhydrides can be characterized by the general formula (II) below, wherein $R^3$ and $R^4$ can be identical or different and represent saturated or unsaturated hydrocarbon groups suitably containing from 8 to 30 carbon atoms, or $R^3$ and $R^4$ together with the —C—O—C— moiety can form a 5 to 6 membered ring, optionally being further substituted with hydro-carbon groups containing up to 30 carbon atoms. Examples of acid anhydrides which are used commercially include alkyl and alkenyl succinic anhydrides and particularly isoocta-decenyl succinic anhydride.

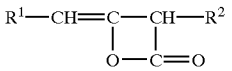

(I)

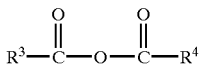

(II)

Suitable ketene dimers, acid anhydrides and organic isocyanates include the compounds disclosed in U.S. Pat. No. 4,522,686, which is hereby incorporated herein by reference. Examples of suitable carbamoyl chlorides include those disclosed in U.S. Pat. No. 3,887,427 which is also incorporated herein by reference.

The non-ionic surfactant comprised in the composition or dispersion is preferably a polyoxyalkylene compound which may comprise a hydrophobic moiety having at least 8 carbon, notably from 8 carbon atoms and up to 36 carbon atoms. The hydrophobic moiety can contain other atoms than carbon and hydrogen as long as the moiety has an overall hydrophobic character. The hydrophobic moiety can be a branched, non-branched saturated or unsaturated hydrocarbon suitably containing aromatic functionalities such as aromatic ring systems or fused aromatic ring systems said aromatic systems being part of the main hydrocarbon structure or being pendent groups linked to the branched or non-branched main hydrocarbon structure. Preferably, the hydrophobic moiety is a non-branched saturated hydrocarbon chain which may contain from 8 up to 36 carbon atoms, suitably from 10 up to 20 carbon atoms, and most preferably from 10 up to 15 carbon atoms. The polyoxyalkylene compound may contain only one type of repeating alkylene oxide unit or different types of alkylene oxide units exemplified by the formula (1) $R_1O$, where $R_1$ is a hydrocarbon group having 2 to 4 carbon atoms. The polyoxyalkylene compound may have from 2 up to 30 alkylene oxide units of the same type or different types, commonly from 5 up to 10 alkylene oxide units, and preferably from 5 up to 8 alkylen oxide units. Most preferably, the polyoxyalkylene compound contains ethylene oxide and/or propylene oxide units, suitably only ethylene oxide units in an amount of from 5 up to 10 ethylene oxide units, preferably from 5 up to 7 ethylene oxide units. The weight average molecular weight of the polyoxyalkylene compound can be up to 4000, suitably from 200 up to 2300. The polyoxyalkylene compound may be exemplified by the formula (2) $R_2$—[—$(R_3O)_n$—]—H, where $R_2$ is a hydrophobic moiety as defined above, suitably a non-branched alkyl group containing from 8 up to 36 carbon atoms, $R_3$ is an ethylene group and n an integer from 2 up to 30. Suitably, the polyoxyalkylene compound is selected from the group comprising tetra(ethylene glycol) undecyl ether, penta(ethylene glycol) undecyl ether, hexa (ethylene glycol) undecyl ether, hepta(ethylene glycol) undecyl ether and deca(ethylene glycol) undecyl ether.

The present composition further comprises a monohydric alcohol. By monohydric alcohol is meat that the alcohol contains one alcohol group. Suitably, the monohydric alcohol is a fatty alcohol functioning as an amphiphilic compound facilitating the homogenisation. Any fatty group linked to the alcohol function may be used as long as the monohydric alcohol has a slight surface active character or is surface active. The monohydric alcohol may contain at least 4 carbon atoms, suitably from 4 up to 20 carbon atoms which carbon atoms may form a non-branched, branched or ring-formed hydrocarbon group. The hydrocarbon group may be saturated or unsaturated optionally containing aromatic systems. Preferably, the monohydric alcohol is a fatty alcohol having the formula (3) $R^4$—OH, where $R_4$ is a saturated or unsaturated hydrocarbon group, suitably containing from 4 to 20 carbon atoms, preferably from 8 to 16 carbon atoms, most preferably 10 to 14 carbon atoms. More preferably, $R_4$ is a saturated hydrocarbon group such as an alkyl group having from 4 to 20 carbon atoms. The monohydric alcohol may be selected from the groups comprising of 1-butanol, 2-methyl-1-propanol, 2-butanol, 2-methyl-2-propanol, 1-pentanol, 2-pentanol, 3-pentanol, 2-methyl-1-butanol, 3-methyl-1-butanol, 2-methyl-2-butanol, 3-methyl-2-butanol, 2,2-dimethyl-1-propanol, 1-hexanol, 2-methyl-1-pentanol, 4-methyl-1-pentanol, 4-methyl-2-pentanol, 2-ethyl-1 butanol, 1-heptanol, 2-heptanol, 3-heptanol, 4-heptanol, 2,4-dimethyl-3-pentanol, 1-octanol, 2-octanol, 2-ethyl-1-hexanol, 3,5-dimethyl-1-hexanol, 2,2,4-trimethyl-1-pentanol. 1-nonanol, 5-nonanol, 3,5-dimethyl-4-heptanol, 2,6-dimehyl-4-heptanol, 3,5,5-trimethyl-1-hexanol, 1-decanol, 1-undecanol, 1-dodecanol, 2,6,8-trimethyl-4-nonanol, 1-tridecanol, 1-tetradecanol, 1-pentadecanol, 1-hexanol, 1-heptadecanol, 1-octadecanol, 1-nonadecanol, 1-eicosanol, 1-hexacosanol.

In accordance with the present invention the composition also comprises an anionic surfactant. Suitably the anionic surfactant is a sulphur containing anionic surfactant which can be in the form of alkaline earth metal salts such as sulphonic acid type or sulphate ester type. The anionic surfactant can for example be a alkyl benzene sulphonic acid having at least one branched or straight alkyl group, said alkyl group commonly containing from 6 to 22 carbon atoms, suitably from 10 to 18 carbon atoms such as dodecyl benzene sulphonic acid and undecyl benzene sulphonic acid. Furthermore, anionic surfactants may embrace alpha olefinsulphonic acids generally comprising from 8 to 20 carbon atoms, preferably from 10 to 18 carbon atoms and more preferably from 12 to 16 carbon atoms; sulfosuccinate esters, i.e. esters of sulfosuccinic acid with alcohols usually alcohols comprising from 6 to 20 carbon atoms, exemplified by dialkyl sulfosuccinates such as di-2-ethylhexylsulphonsuccinate, and dicycloalkyl sulfosuccinates such as dicyclohexyl sulphosuccinate; naphtahlene sulphonic acids and alkyl naphthalene sulphonic acids having at least one alkyl group containing 1 to 18 carbon atoms like diisopropyinaphtalene sulphonic acids, as well as condensation products of these with formaldehyd suitably with a polycondensation degree of from 1 tp 20, preferablt from 1 to 8; alkenesulphonic acids generally comprising from 8 to 20 carbon atoms exemplified by tetradecyl sulphonic acid; and fatty acid amide sulphonic acids commonly containing from 10 to 20 carbon atoms such as N-methyl-oleylamidoethyl sulphonic acid, petroleum sulphonic acids, ligninsulphonic acids, just to mention a few.

Suitable sulphate esters include alkyl sulphates such as sulphate esters of straight chain and/or branched saturated and/or unsaturated alcohols suitably containing from 6 to 20 carbon atoms, preferably from 12–18 carbon atoms exemplified by decyl sulphate, lauryl sulphate, sulphates of oxo alcohols having from 11 to 12 carbon atoms having a side chain content of 50% or more, sulphated alpha olefins commonly havinf from 12 to 18 carbon atoms. Polyoxyalkylene alkyl sulphates, i.e. sulphate esters of alkyleneoxy adducts of straight chain and/or branched saturated and/or unsaturated alcohols having generally from 6 to 20 carbon atoms, containing commonly 2 to 50 moles, preferably 2 to 20 moles of alkyleneoxy units per mole of alcohol, such as sulphates of decylalcohol EO(1), lauryl alcohol-EO(4) and cetyl alcohol-EO(8); polyoxyalkylene alkylaryl ether sulphates, i.e. sulphate esters of alkyleneoxy adducts of alkyl phenols having at least one alkyl group suitably containing from8 to 12 carbon atoms, containing usually 2 to 50 moles, preferably 2 to 20 moles of alkyleneoxy per moles of phenol, such as nonylphenol-EO(2) sulphate ester; Fatty ester sulphates, i.e. sulphates of saturated and/or unsaturated fatty acid esters having from 10 to 20 carbon atoms such as mono-, di-, and tri-glycerides and lower and higher alkyl esters, exemplified by monoglyceride sulphates, i.e. coconut oil fatty acid monoglyceride sulphate, sulphated oils such as turkey red oil and sulphated fatty acid esters like sulphated metyloleate. Preferably, the anionic surfactants are alkylaryl sulphonic acids or alkenyaryl sulphonic acids such as alkyl benzene sulphonic acids, where the alkyl group can be a linear or branched, suitably branched, containing from 6 up to 20 carbon atoms, more preferably from 8 to 14 carbon atoms. The weight average molecular weight of the anionic surfactant usually is from 200 to 2000, suitably from 200 to 600, preferably from 200 to 400.

The present invention referring to a sizing composition comprising a sizing agent, a non-ionic surfactant, an anionic surfactant and a monohydric alcohol may further comprise additional compounds such as synthetic and/or natural polymers, i.e. polyelectrolytes having a net anionic or cationic charge. Such polymers are, e.g. polysaccharides like starch, condensation polymers such as polyamines and chain reaction polymers like vinyladdition polymers.

The amount of sizing agent comprised in the essentially water-free composition may range from 70 to 99% by weight based on total composition, suitably from 75 to 90% by weight, and most preferably from 80 to 90% by weight. By essentially water-free is meant that minor amounts of water or any other aqueous solution can be present as long as the stability of the sizing composition is not greatly impaired, preferably less than 5% by weight, more preferably less than 1% by weight. The storage stability will naturally increase as the water content of the composition diminish, thus, most preferably the composition is water-free. The quantity of sizing agent in the aqueous composition may range from 1 up to 50% by weight based on total composition, preferably from 3 to 45% by weight and most preferably from 25 up to 45% by weight based on total composition.

The amount of non-ionic surfactant present in the composition, i.e. the essentially water-free and aqueous composition, can be from 0.5 up to 20% by weight based on the (dry) sizing agent, more preferably from 5 up to 15% by weight, and most preferably from 5 to 10% by weight.

The amount of anionic surfactant comprised in the water-free and aqueous composition ranges from 0.5 up to 10% by weight based on sizing agent, suitably from 2 up to 5% by weight.

The amount of monohydric alcohol contained in the compositions may vary from 0.5 up to 20% by weight based on the sizing agent, suitably from 5 up to 10% by weight.

Generally the quantity of non-ionic surfactant, anionic surfactant and monohydric alcohol, respectively, comprised in the compositions are so chosen to render a composition with optimal properties as to emulsifiability and sizing performance of the pulp suspension.

According to one preferred embodiment of the present invention the weight ration of non-ionic surfactant to anionic surfactant in the essentially water-free and aqueous composition is between 10:1 to 1:10, more preferably between 7:1 to 1:3, and most preferably between 5:1 to 1:2.

The dispersions of the present invention can be used as sizing agents in conventional manner in the production of paper using any type of cellulosic fibres and the compositions can be used both for surface sizing and internal sizing. The term "paper", as used herein, is meant to include not only paper but all types of cellulose-based products in sheet and web form, including, for example, board and paperboard. The sizing compositions may be added to any stock containing cellulosic fibres, optionally in combination with mineral fillers, and usually the content of cellulosic fibres is at least 50% by weight, based on dry stock. Examples of mineral fillers of conventional types include kaolin, china clay, titanium dioxide, gypsum, talc and natural and synthetic calcium carbonates such as chalk, ground marble and precipitated calcium carbonate.

The amount of sizing agent added to the stock can be from 0.01 to 5% by weight suitably from 0.05 to 1.0% by weight, based on the dry weight of cellulosic fibres and optional fillers, where the dosage is mainly dependent on the quality of the pulp or paper to be sized, the sizing agent used and the level of sizing desired.

The invention is further illustrated in the following Examples which, however, are not intended to limit the same.

EXAMPLE 1

The emulsions in this example were prepared by adding an essentially water-free composition of AKD, non-ionic surfactant, anionic surfactant and monohydric alcohol to water having a temperature of 60° C. The obtained aqueous mixture was stirred at 60° C. for about 30 minutes (magnetic stirrer at approx. 400 rpm). Standard grade AKD supplied from Eka Chemicals AB was used in all compositions (emulsions). The specific surfactants and alcohol and ratios (amounts) present in the compositions are apparent from table 1 below.

The stability and the particle size of the emulsions were measured. The stability was evaluated by measuring the height of cream of the emulsions after they were held at 60° C. for one hour subsequent the emulsification process in a flat bottomed test tube. In Table 1 the stability is indicated by an integer from 1 to 5, where 1 indicates poor emulsion stability and 5 good emulsion stability.

The particle size of the emulsions were measured with a low angle laser diffraction instrument, Malvern Mastersizer Microplus. Before the measurement the emulsions were diluted by adding one part per volume of emulsion to 100 parts of water were the temperature of emulsion and water was 60° C. The particle size measurement are presented as D(50%) and D(90%) representing the maximum diameters of 50% and 90% of the particles, respectively.

TABLE 1

| Test no. | weight ratio AKD:alcohol[A] | monohydric alcohol | weight ratio surfactant:oil[B] | non-ionic surfactant | anionic surfactant | weight ratio non-ionic surfactant: anionic surfactant |
|---|---|---|---|---|---|---|
| 1 | 90:10 | dodecyl alcohol | 5:95 | deca (ethylene glycol) undecyl ether | branched calcium dodecyl benzene sulphonate | 5:1 |
| 2 | 90:10 | dodecyl alcohol | 10:90 | deca (ethylene glycol) undecyl ether | branched calcium dodecyl benzene sulphonate | 5:1 |
| 3 | 90:10 | dodecyl alcohol | 10:90 | penta (ethylene glycol) undecyl ether | branched calcium dodecyl benzene sulphonate | 5:1 |
| 4 | 90:10 | dodecyl alcohol | 10:90 | hexa (ethylene glycol) undecyl ether | branched calcium dodecyl benzene sulphonate | 3:1 |

TABLE 1-continued

| Test no. | weight ratio AKD:alcohol[A] | monohydric alcohol | weight ratio surfactant:oil[B] | non-ionic surfactant | anionic surfactant | weight ratio non-ionic surfactant: anionic surfactant |
|---|---|---|---|---|---|---|
| 5 | 90:10 | dodecyl alcohol | 10:90 | hexa (ethylene glycol) undecyl ether | branched calcium dodecyl benzene sulphonate | 5:1 |
| 6 | 90:10 | dodecyl alcohol | 10:90 | hepta (ethylene glycol) undecyl ether | branched calcium dodecyl benzene sulphonate | 3:1 |
| 7 | 90:10 | dodecyl alcohol | 10:90 | hepta (ethylene glycol) undecyl ether | branched calcium dodecyl benzene sulphonate | 5:1 |
| 8 | 90:10 | dodecyl alcohol | 10:90 | hexa (ethylene glycol) undecyl ether | branched calcium dodecyl benzene sulphonate | 1:1 |
| 9 | 90:10 | dodecyl alcohol | 10:90 | hexa (ethylene glycol) undecyl ether | branched calcium dodecyl benzene sulphonate | 2:1 |

[A]here alcohol means monohydric alcohol
[B]here oil includes AKD and monohydric alcohol, whereas surfactant includes anionic and non-ionic surfactant

TABLE 2

Particle size and stability

| Test no. | Stability | Particle size, μm D(v, 0.5) | D (v, 0.9) |
|---|---|---|---|
| 1 | 4 | 9 | 48 |
| 2 | 4 | 8 | 52 |
| 3 | 4 | 5 | 27 |
| 4 | 5 | 5 | 22 |
| 5 | 4 | 6 | 29 |
| 6 | 5 | 5 | 22 |
| 7 | 4 | 6 | 29 |
| 8 | 4 | 7 | 30 |
| 9 | 5 | 5 | 22 |

EXAMPLE 2

Two emulsions were prepared as described in example 1 containing equal amounts by weight of 7.23 g alkyl ketene dimer, 0.67 g hexa(ethyleneglycol)monondecyl ether ($C_{11}E_6$) and 0.34 g calcium dodecyl benzene sulphonate (Ca-DBS, 65% active). However, one emulsion, here referred to as emulsion 1 (according to the invention), also contained 0.80 g dodecyl alcohol. Emulsion 1 furthermore contained 16.04 g water, whereas emulsion 2 (having no dodecyl alcohol) contained 16.84 g water. The stability and particle size of the emulsions were measured as indicated in example 1. The results are shown in tales 3 and 4.

TABLE 3

Particle size*

| Emulsion | D(v, 0.5) μm | D(v, 0.9) μm |
|---|---|---|
| 1 | 17.84 | 37.39 |
| 2 | 36.83 | 78.89 |

*The equipment for measuring the particle size was not identical to the equipment used in example 1.

TABLE 4

Emulsion stability

| Emulsion | Height of emulsion (mm) | Height of clear phase (mm) | Ratio (height of emulsion/ total height) |
|---|---|---|---|
| 1 | 31 | 2 | 0.94 |
| 2 | 18 | 15 | 0.55 |

Apart from the particle size and stability, the internal sizing performance was further evaluated by sizing a standard stock containing 80 weight % birch/pine pulp (60/40, 200 CSF), 20 weight % calcium carbonate and having a pH of 8.44. The retention system used comprised cationic starch and silica sol. The sizing results of emulsion 1 and 2 are apparent from table 5. The emulsions were added to the stock in an amount of 3 kg

TABLE 5

Sizing properties

| Emulsion | Cobb 60 |
|---|---|
| no addition of sizing emulsion | 104 |
| Emulsion 1 | 21 |
| Emulsion 2 | 35 |

EXAMPLE 3

Two sizing emulsions (emulsion 1 and 2) were prepared both containing 0.15 g AKD, 0.0075 g acetate of ziegler alcohol ($C_{12-14}$ EO(8)), 0.0075 g acetate of tristyrenated phenol PO(10)EO(25)PO(3) and 0.0075 g calcium dodecyl benzene sulphonate (Ca-DBS, 65% active). To emulsion 2 (according to invention) was also added, apart from the above mentioned constituents, 0.0167 g dodecyl alcohol and 29.81 g water, whereas to emulsion 1 only 29.83 g water was added, apart from the above mentioned constituents. The two emulsions were prepared as outlined in example 1. The particle size distribution (table 6) as well as the sizing efficiency (table 7) of emulsions 1 and 2 were evaluated. The particle size was measured according to the procedure in example 1. The cobb 60 method was used for measuring the sizing effect employing a similar furnish as in example 2 and identical retention system with same amounts added.

TABLE 6

| Particle size | | |
|---|---|---|
| Emulsion | D(v, 0.5) $\mu$m | D(v, 0.9) $\mu$m |
| 1 | 19.10 | 38.22 |
| 2 | 8.54 | 20.61 |

TABLE 7

| Sizing properties | | |
|---|---|---|
| Emulsion | Added amount of AKD, kg sizing agent/ tonne dry fibre | cobb 60 |
| no addition of emulsion | — | 117 |
| 1 | 2 | 45 |
| 1 | 3 | 26 |
| 2 | 2 | 26 |
| 2 | 3 | 20 |

What is claimed is:

1. An essentially water-free sizing composition, wherein the composition comprises a sizing agent, a non-ionic surfactant, an anionic surfactant and a monohydric alcohol.

2. A sizing composition according to claim 1, wherein the monohydric alcohol is a fatty alcohol.

3. A sizing composition according to claim 2, wherein the monohydric alcohol comprises at least 4 carbon atoms.

4. A sizing composition according to claim 2, wherein the monohydric alcohol comprises an alkyl group having from 4 up to 20 carbon atoms.

5. A sizing composition according to claim 1, wherein the non-ionic surfactant is a polyoxyalkylene compound.

6. A sizing composition according to claim 5, wherein the polyoxyalkylene compound comprises a hydrophobic moiety having at least 8 carbon atoms.

7. A sizing composition according to claim 1, wherein the weight average molecular weight of the non-ionic surfactant is up to 4000.

8. A sizing composition according to claim 1, wherein the weight average molecular weight of the anionic surfactant is up to 2000.

9. A sizing composition according to claim 1, wherein the ratio of non-ionic surfactant to anionic surfactant is from 10:1 to 1:10.

10. A sizing composition according to claim 1, wherein the sizing agent is a cellulose-reactive sizing agent.

11. A sizing composition according to claim 1, wherein the sizing agent is a ketene dimer or an acid anhydride.

12. A sizing composition according to claim 1, wherein the sizing agent is a ketene dimer.

13. A method of producing cellulose based products which comprises applying to said cellulose based products a sizing composition according to claim 1 wherein the sizing composition is either added as a stock size or applied as a surface size.

14. Method for producing an aqueous dispersion comprising homogenising the sizing agent in the presence of a non-ionic surfactant, an anionic surfactant and a monohydric alcohol.

15. An aqueous sizing dispersion, wherein the dispersion comprises a sizing agent, a non-ionic surfactant, an anionic surfactant and a monohydric alcohol.

16. A sizing dispersion according to claim 15, wherein the monohydric alcohol is a fatty alcohol.

17. A sizing dispersion according to claim 16, wherein the monohydric alcohol comprises at least 4 carbon atoms.

18. A sizing dispersion according to claim 16, wherein the monohydric alcohol comprises an alkyl group having from 4 up to 20 carbon atoms.

19. A sizing dispersion according to claim 15, wherein the non-ionic surfactant is a polyoxyalkylene compound.

20. A sizing dispersion according to claim 19, wherein the polyoxyalkylene compound comprises a hydrophobic moiety having at least 8 carbon atoms.

21. A sizing dispersion according to claim 15, wherein the weight average molecular weight of the non-ionic surfactant is up to 4000.

22. A sizing dispersion according to claim 15, wherein the weight average molecular weight of the anionic surfactant is up to 2000.

23. A sizing dispersion according to claim 15, wherein the ratio of non-ionic surfactant to anionic surfactant is from 10.1 to 1:10.

24. A sizing dispersion according to claim 15, wherein the sizing agent is a cellulose reactive sizing agent.

25. A sizing dispersion according to claim 15, wherein the sizing agent is a ketene dimer or an acid anhydride.

26. A sizing dispersion according to claim 15, wherein the sizing agent is a ketene dimer.

27. A method of producing cellulose based products which comprises applying to said cellulose based products a sizing composition according to claim 15 wherein the sizing composition is either added as a stock size or applied as a surface size.

* * * * *